US007335104B2

(12) United States Patent
Benbrahim

(10) Patent No.: US 7,335,104 B2
(45) Date of Patent: Feb. 26, 2008

(54) GAMING MACHINE WITH EXPLANATIONS OF PAYOUTS WON

(75) Inventor: Jamal Benbrahim, Reno, NV (US)

(73) Assignee: IGT, Reno, NV (US)

( * ) Notice: Subject to any disclaimer, the term of this patent is extended or adjusted under 35 U.S.C. 154(b) by 50 days.

(21) Appl. No.: 10/109,226

(22) Filed: Mar. 28, 2002

(65) Prior Publication Data

US 2003/0186736 A1 Oct. 2, 2003

(51) Int. Cl.
*A63F 9/24* (2006.01)

(52) U.S. Cl. ..... 463/35; 463/20; 463/42

(58) Field of Classification Search ..... 463/20, 463/16, 42, 35

See application file for complete search history.

(56) References Cited

U.S. PATENT DOCUMENTS

| | | | | |
|---|---|---|---|---|
| 5,518,253 | A | 5/1996 | Pocock et al. | |
| 5,788,573 | A * | 8/1998 | Baerlocher et al. | 463/16 |
| 5,833,537 | A * | 11/1998 | Barrie | 463/21 |
| 5,851,149 | A * | 12/1998 | Xidos et al. | 463/42 |
| 6,110,041 | A * | 8/2000 | Walker et al. | 463/20 |
| 6,322,309 | B1 | 11/2001 | Thomas et al. | |
| 6,347,996 | B1 | 2/2002 | Gilmore et al. | |
| 6,493,662 | B1 * | 12/2002 | Gillam | 704/9 |
| 6,517,433 | B2 * | 2/2003 | Loose et al. | 463/20 |
| 6,685,563 | B1 * | 2/2004 | Meekins et al. | 463/25 |

FOREIGN PATENT DOCUMENTS

| | | | |
|---|---|---|---|
| DE | 32 42 890 | | 5/1984 |
| DE | 44 03 688 | | 8/1995 |
| DE | 19926280 | | 3/2000 |
| EP | 0 790 589 | | 8/1997 |
| GB | 2 057 738 | A | 4/1981 |
| GB | 2057738 | A * | 4/1981 |
| GB | 2 165 074 | | 4/1986 |
| RU | 17678 | U | 4/2001 |

OTHER PUBLICATIONS

Office Action for the Australian Patent Application No. 2002248732 from Australian Government—IP Australia, dated Feb. 27, 2006 (2 pages).

English-Language Abstract for DE-19926280.

International Search Report, PCT/US02/10003 mailed Dec. 4, 2002.

Office Action from corresponding Russian application No. 2004131660 with English translation.

(Continued)

*Primary Examiner*—Ronald Laneau
*Assistant Examiner*—Travis Banta
(74) *Attorney, Agent, or Firm*—Armstrong Teasdale LLP

(57) ABSTRACT

A gaming apparatus includes a display unit, a value input device, and a controller coupled to the display unit and value input device. The controller includes a memory and a processor programmed to allow a person to make a wager and cause a video image representing a game to be generated on the display unit. The controller can further be programmed to determine an outcome of the game and a value payout associated with the outcome. The controller can further be programmed to generate an audible or verbal explanation of the value payout based on the information defined in a stored payout data contained within the controller.

40 Claims, 15 Drawing Sheets

OTHER PUBLICATIONS

*iGame-Plus Series, Roamin' Rhinos*, IGT, 1999 (1 page).
*Black Widow Casino, Games Preview, Let 'Em Ride*, Black Widow Casino, 2001 (3 pages).
*How to Play Video Multi-Games*, Argosy Gaming Company, 2002 (2 pages).
*Slots Guide-free slots strategy @ BettorsLuck.com* , BettorsLuck. Com, 1999-2002 (2 pages).
English language abstract for DE-32 42 890, Nov. 16, 1982.
English language abstract for DE-44 03 688, Feb. 7, 1998.
English translation of portions of claims 1 and 4 of RU-17678 U, Apr. 20, 2001.
Office Action for Russian Patent Application No. 2004131660 from the Patent Office of the Russian Federation, dated Feb. 20, 2006 (9 pages).

* cited by examiner

FIG. 8
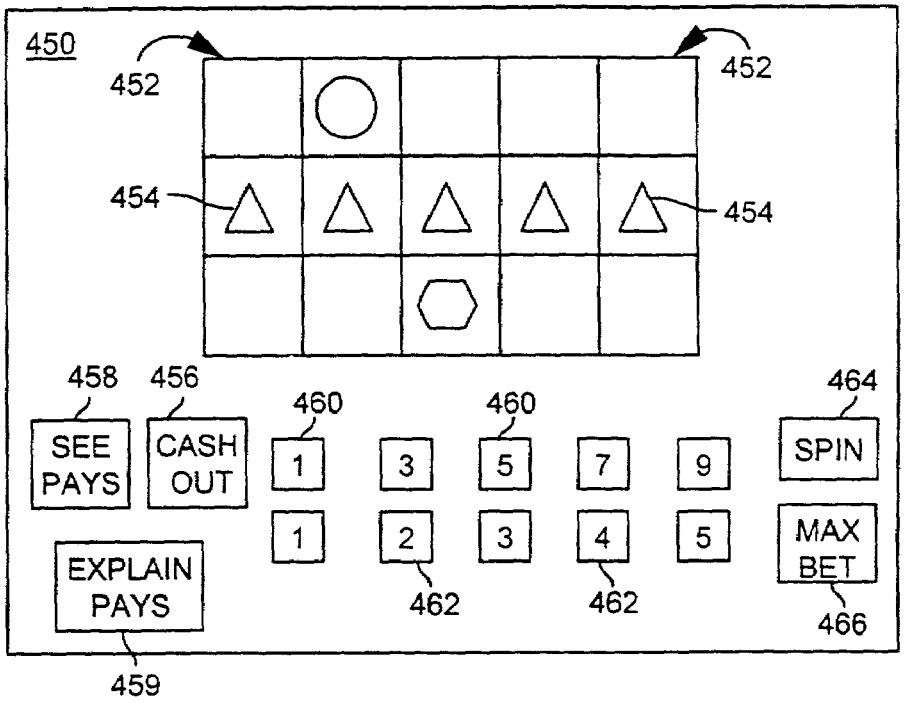
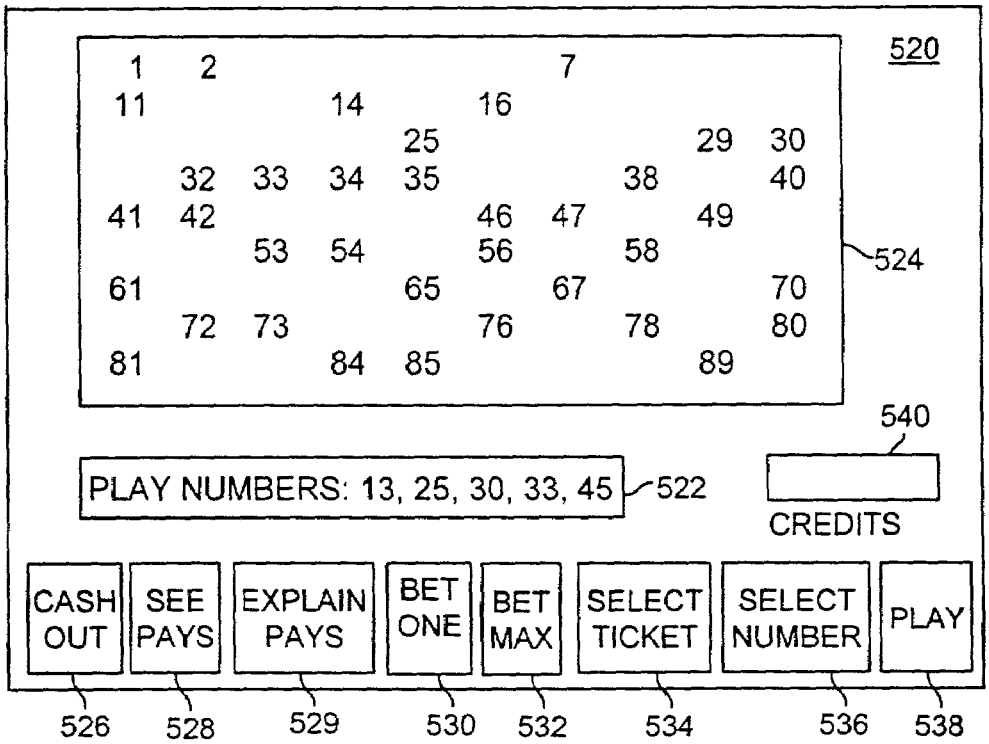
FIG. 9

GAMING MACHINE WITH EXPLANATIONS OF PAYOUTS WON

BACKGROUND OF THE INVENTION

The present invention is directed to a casino gaming apparatus, which could be either an individual gaming unit or a casino gaming system having a plurality of gaming units, that are capable of explaining to a player how the individual winning combinations contributed to the total payout value awarded by the gaming apparatus.

Traditional gaming units, such as video slot machines by way of example, typically allow a player to wager on one or more paylines and spin a plurality of reels in the hopes that a winning combination of symbols on the stopped reels will appear on one or more of the paylines that were purchased. A payoff to the player depends on the specific symbols that occur on the wagered payline with more rare symbols resulting in higher payouts than the more common symbols. The rates at which the different winning combinations pay out may be either mechanically configured or electronically defined in stored payout tables, depending on the physical nature of the apparatus. The outcome of the exemplary video slot machine game often results in multiple winning combinations being displayed simultaneously and the total payout value awarded the player is based on the combined contribution of these individual winning combinations. Given the potential number of winning combinations, it is often difficult for the player to understand how the total payout value was derived. To explain the steps resulting in the total payout value, the player can select a "See Pays" option, for example, that causes a paytable containing the stored payout data to be displayed. With this information the player may be able to determine how the total payout was calculated.

In instances where the winning combinations are complicated and difficult to understand, the player may require the additional assistance of an attendant to decipher the calculations used to derive the total payout value. As a result, gambling establishments are required to provide additional customer service staff to insure that the player's questions are answered. This in turn slows rate at which the games are played, ultimately diminishing the gambling establishment's total revenue.

SUMMARY OF THE INVENTION

In one aspect, the invention is directed to a gaming apparatus that may include a display unit capable of generating video images, a value input device, and a controller operatively coupled to the display unit and the value input device. The controller may comprise a processor and a memory, and may be programmed to allow a person to make a wager, to make an automated selection from among a plurality of user-selectable options presented to the person, to cause a video image representing a video gambling game to be generated on the display unit, and to determine an outcome of the game and a value payout associated with the outcome of the game.

The video image may represent a game, said game being one of the following games: video poker, video slots, and video bingo. In which case the video image may comprise an image of at least five playing cards if the game comprises video poker; the video image may comprise an image of a plurality of simulated slot machine reels if the game comprises video slots; the video image may comprise an image of a plurality of numbers if the game comprises video keno; and the video image may comprise an image of a bingo grid if the game comprises video bingo.

The controller may further be programmed to allow the player to request an explanation of the total value payout once the outcome of the game is known. The request causes the controller to generate an explanation of each winning combination awarded to the player as defined by the stored payout data in the paytable.

The invention may further be directed to a gaming method that may comprise causing a video game image to be generated, performing an automatic selection from among a plurality of user-selectable options, determining an outcome of the game represented by the video game image, determining a value payout associated with the outcome of the game, and explaining the calculations made to determine the total payout value to the player.

The features and advantages of the present invention will be apparent to those of ordinary skill in the art in view of the detailed description of various embodiments, which is made with reference to the drawings, a brief description of which is provided below.

BRIEF DESCRIPTION OF THE DRAWINGS

FIG. 8 is an illustration of an embodiment of a visual display that may be displayed during performance of the slots routine of FIG. 10;

FIG. 9 is an illustration of an embodiment of a visual display that may be displayed during performance of the video keno routine of FIG. 11;

DETAILED DESCRIPTION OF VARIOUS EMBODIMENTS

Figure 1:
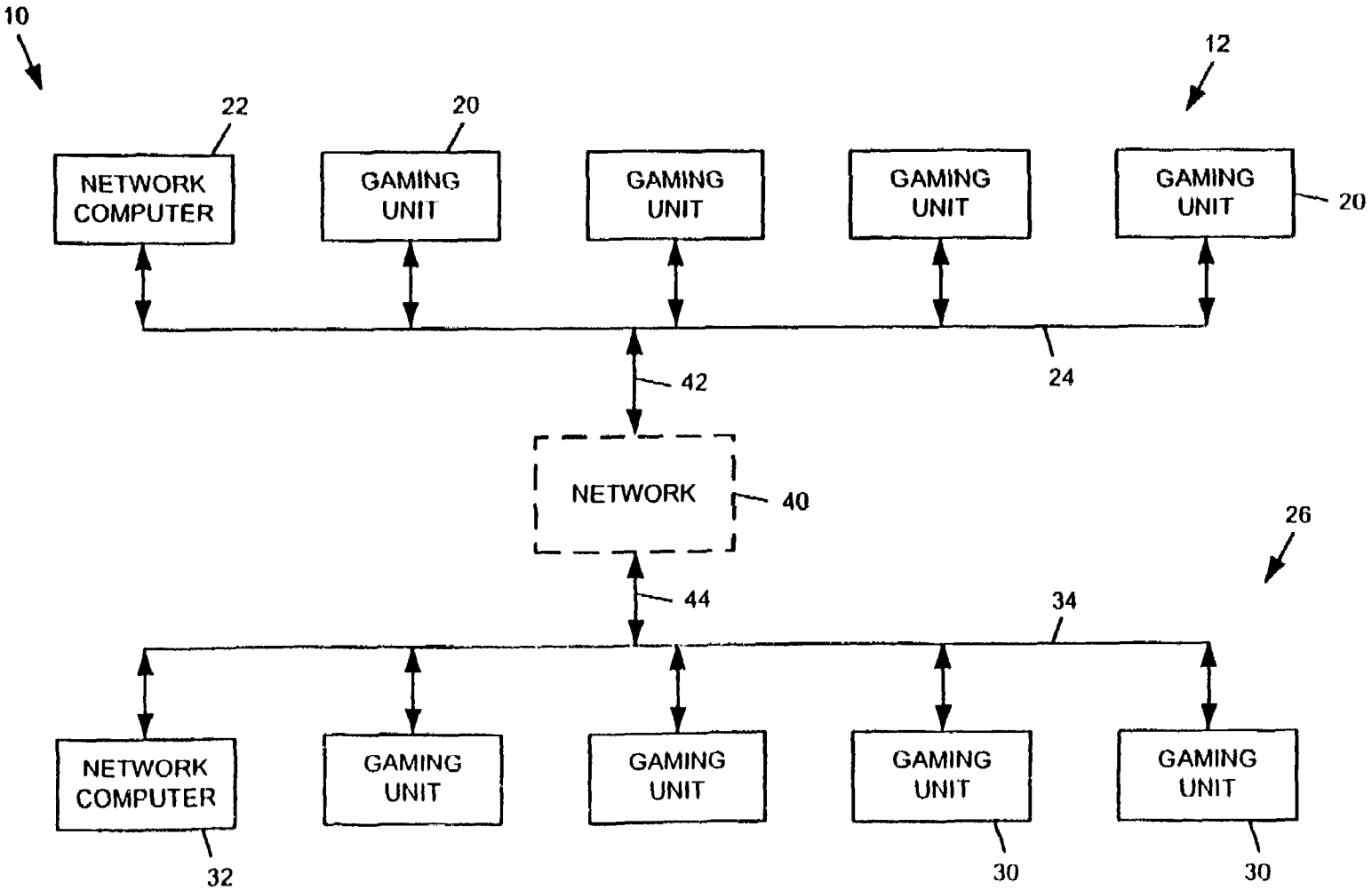
FIG. 1 is a block diagram of an embodiment of a gaming system in accordance with the invention.

FIG. 1 illustrates an embodiment of a casino gaming system 10 in accordance with the invention. Referring to FIG. 1, the casino gaming system 10 may include a first group or network 12 of casino gaming units 20 operatively coupled to a network computer 22 via a network data link or bus 24. The casino gaming system 10 may include a second group or network 26 of casino gaming units 30 operatively coupled to a network computer 32 via a network data link or bus 34. The first and second gaming networks 12, 26 may be operatively coupled to each other via a network 40, which may comprise, for example, the Internet, a wide area network (WAN), or a local area network (LAN) via a first network link 42 and a second network link 44.

The first network 12 of gaming units 20 may be provided in a first casino, and the second network 26 of gaming units 30 may be provided in a second casino located in a separate geographic location than the first casino. For example, the two casinos may be located in different areas of the same city, or they may be located in different states. The network 40 may include a plurality of network computers or server computers (not shown), each of which may be operatively interconnected. Where the network 40 comprises the Internet, data communication may take place over the communication links 42, 44 via an Internet communication protocol.

The network computer 22 may be a server computer and may be used to accumulate and analyze data relating to the operation of the gaming units 20. For example, the network computer 22 may continuously receive data from each of the gaming units 20 indicative of the dollar amount and number of wagers being made on each of the gaming units 20, data indicative of how much each of the gaming units 20 is paying out in winnings, data regarding the identity and gaming habits of players playing each of the gaming units 20, etc. The network computer 32 may be a server computer and maybe used to perform the same or different functions in relation to the gaming units 30 as the network computer 22 described above.

Although each network 12, 26 is shown to include one network computer 22, 32 and four gaming units 20, 30, it should be understood that different numbers of computers and gaming units may be utilized. For example, the network 12 may include a plurality of network computers 22 and tens or hundreds of gaming units 20, all of which may be interconnected via the data link 24. The data link 24 may provided as a dedicated hardwired link or a wireless link. Although the data link 24 is shown as a single data link 24, the data link 24 may comprise multiple data links.

Figure 2:
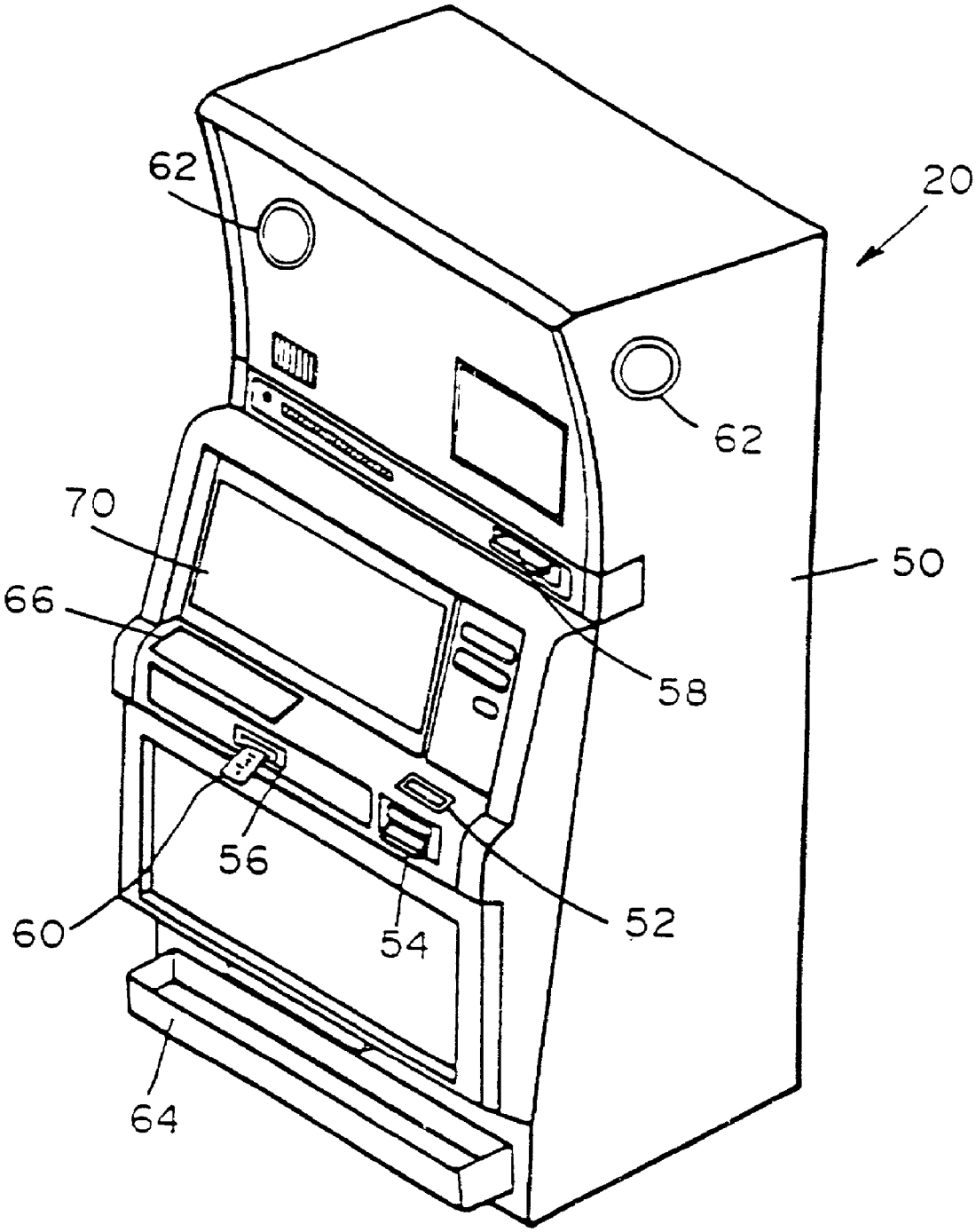
FIG. 2 is a perspective view of an embodiment of one of the gaming units shown schematically in FIG. 1.

FIG. 2 is a perspective view of one possible embodiment of one or more of the gaming units 20. Although the following description addresses the design of the gaming units 20, it should be understood that the gaming units 30 may have the same design as the gaming units 20 described below. It should be understood that the design of one or more of the gaming units 20 may be different than the design of other gaming units 20, and that the design of one or more of the gaming units 30 may be different than the design of other gaming units 30. Each gaming unit 20 may be any type of casino gaming unit and may have various different structures and methods of operation. For exemplary purposes, various designs of the gaming units 20 are described below, but it should be understood that numerous other designs may be utilized.

Referring to FIG. 2, the casino gaming unit 20 may include a housing or cabinet 50 and one or more input devices, which may include a coin slot or acceptor 52, a paper currency acceptor 54, a ticket reader/printer 56 and a card reader 58, which may be used to input value to the gaming unit 20. A value input device may include any device that can accept value from a customer. As used herein, the term "value" may encompass gaming tokens, coins, paper currency, ticket vouchers, credit or debit cards, and any other object representative of value.

If provided on the gaming unit 20, the ticket reader/printer 56 may be used to read and/or print or otherwise encode ticket vouchers 60. The ticket vouchers 60 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 60 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 60 could be printed with an optically readable material such as ink, or data on the ticket vouchers 60 could be magnetically encoded. The ticket reader/printer 56 may be provided with the ability to both read and print ticket vouchers 60, or it may be provided with the ability to only read or only print or encode ticket vouchers 60. In the latter case, for example, some of the gaming units 20 may have ticket printers 56 that may be used to print ticket vouchers 60, which could then be used by a player in other gaming units 20 that have ticket readers 56.

If provided, the card reader 58 may include any type of card reading device, such as a magnetic card reader or an optical card reader, and may be used to read data from a card offered by a player, such as a credit card or a player tracking card. If provided for player tracking purposes, the card reader 58 may be used to read data from, and/or write data to, player tracking cards that are capable of storing data representing the identity of a player, the identity of a casino, the player's gaming habits, etc.

The gaming unit 20 may include one or more audio speakers 62, a coin payout tray 64, an input control panel 66, and a color video display unit 70 for displaying images relating to the game or games provided by the gaming unit 20. The audio speakers 62 may generate audio representing sounds such as the noise of spinning slot machine reels, a dealer's voice, music, announcements or any other audio related to a casino game. The input control panel 66 maybe provided with a plurality of pushbuttons or touch-sensitive areas that may be pressed by a player to select games, make wagers, make gaming decisions, etc.

Figure 2A:
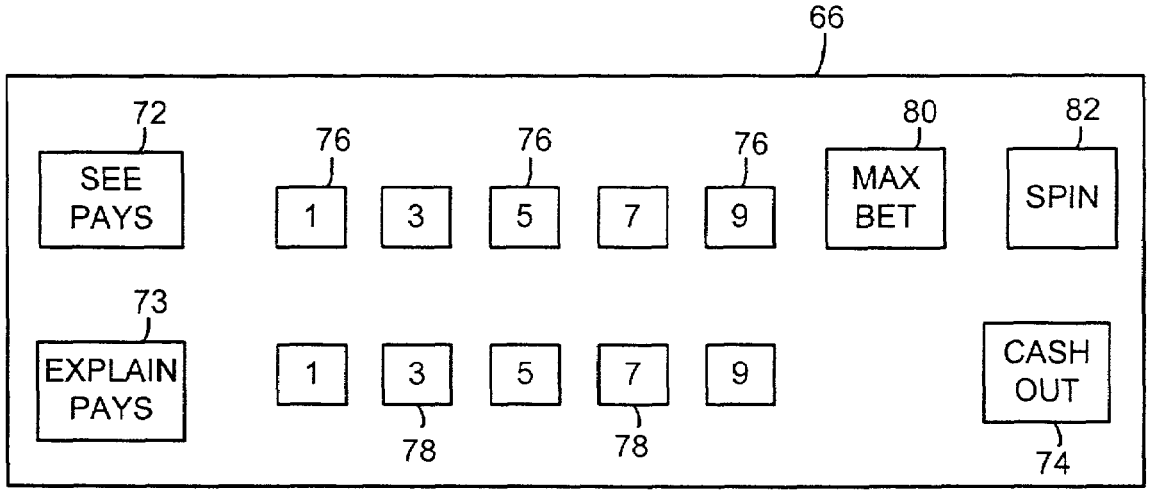
FIG. 2A illustrates an embodiment of a control panel for a gaming unit.

FIG. 2A illustrates one possible embodiment of the control panel 66, which may be used where the gaming unit 20 is a slot machine having a plurality of mechanical or "virtual" reels. Referring to FIG. 2A, the control panel 66 may include a "See Pays" button 72 that, when activated, causes the display unit 70 to generate one or more display screens showing the odds or payout information for the game or games provided by the gaming unit 20. The control panel may further include an "Explain Pays" button 73 that, when selected by the player, causes the controller to highlight the winning combinations one by one and generate an explanation of each winning combination's contribution to the total payout value for the player. As used herein, the term "button" is intended to encompass any device that allows a player to make an input, such as an input device that must be depressed to make an input selection or a display area that a player may simply touch. The control panel 66 may include a "Cash Out" button 74 that may be activated when a player decides to terminate play on the gaming unit 20, in which case the gaming unit 20 may return value to the player, such as by returning a number of coins to the player via the payout tray 64.

If the gaming unit 20 provides a slots game having a plurality of reels and a plurality of paylines which define winning combinations of reel symbols, the control panel 66 may be provided with a plurality of selection buttons 76, each of which allows the player to select a different number of paylines prior to spinning the reels. For example, five buttons 76 may be provided, each of which may allow a player to select one, three, five, seven or nine paylines. If the gaming unit 20 provides a slots game having a plurality of reels, the control panel 66 may be provided with a plurality of selection buttons 78 each of which allows a player to specify a wager amount for each payline selected. For example, if the smallest wager accepted by the gaming unit 20 is a quarter ($0.25), the gaming unit 20 may be provided with five selection buttons 78, each of which may allow a player to select one, two, three, four or five quarters to wager for each payline selected. In that case, if a player were to activate the "5" button 76 (meaning that five paylines were to be played on the next spin of the reels) and then activate the "3" button 78 (meaning that three coins per payline were to be wagered), the total wager would be $3.75 (assuming the minimum bet was $0.25).

The control panel 66 may include a "Max Bet" button 80 to allow a player to make the maximum wager allowable for a game. In the above example, where up to nine paylines were provided and up to five quarters could be wagered for each payline selected, the maximum wager would be 45 quarters, or $11.25. The control panel 66 may include a spin button 82 to allow the player to initiate spinning of the reels of a slots game after a wager has been made.

In FIG. 2A, a rectangle is shown around the buttons 72, 74, 75, 76, 78, 80, 82. It should be understood that that rectangle simply designates, for ease of reference, an area in which the buttons 72, 74, 75, 76, 78, 80, 82 may be located. Consequently, the term "control panel" should not be construed to imply that a panel or plate separate from the housing 50 of the gaming unit 20 is required, and the term "control panel" may encompass a plurality or grouping of player activatable buttons.

Although one possible control panel 66 is described above, it should be understood that different buttons could be utilized in the control panel 66, and that the particular buttons used may depend on the game or games that could be played on the gaming unit 20. Although the control panel 66 is shown to be separate from the display unit 70, it should be understood that the control panel 66 could be generated by the display unit 70. In that case, each of the buttons of the control panel 66 could be a colored area generated by the display unit 70, and some type of mechanism may be associated with the display unit 70 to detect when each of the buttons was touched, such as a touch-sensitive screen.

Gaming Unit Electronics

Figure 3:
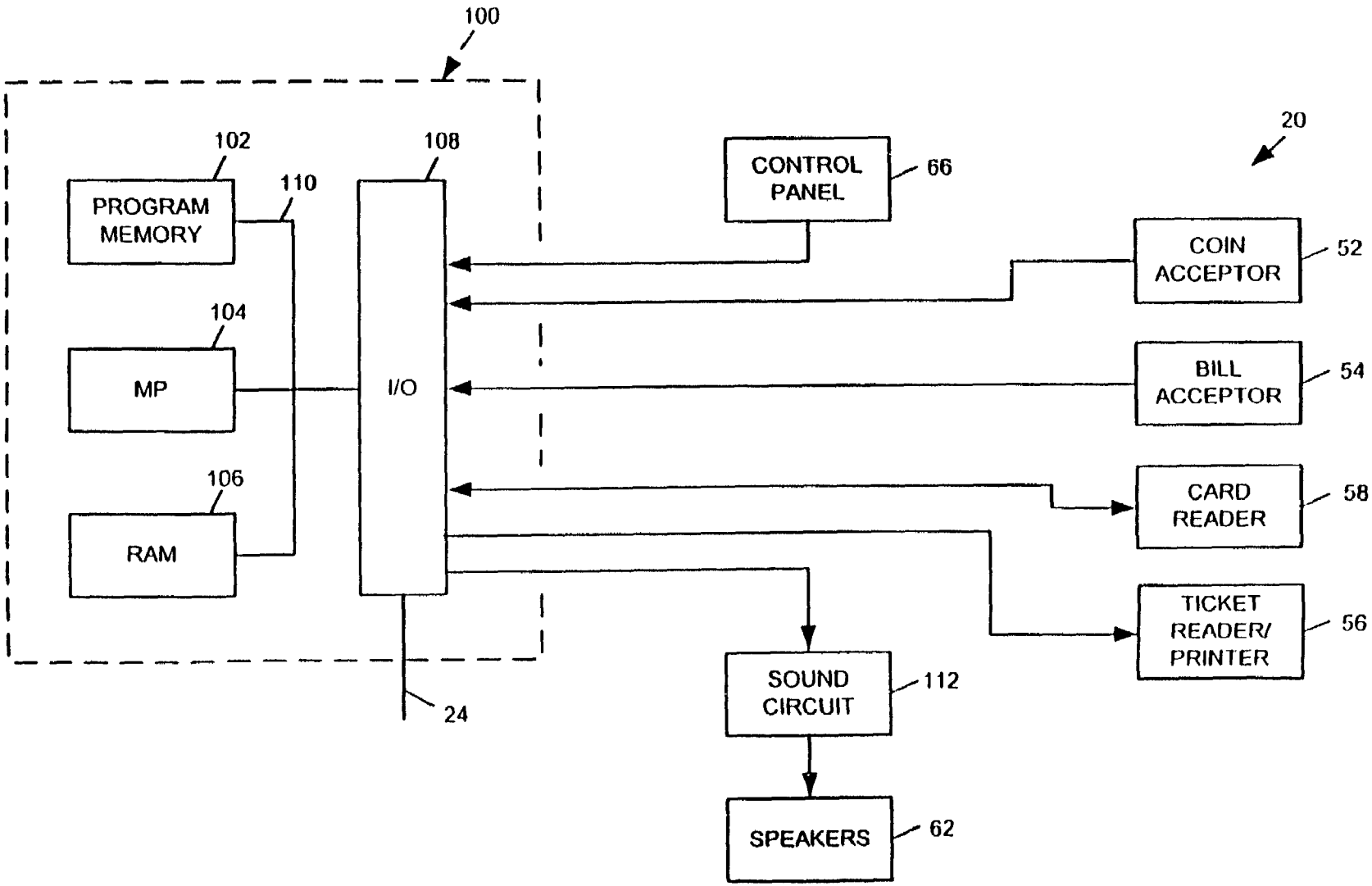
FIG. 3 is a block diagram of the electronic components of the gaming unit of FIG. 2.

FIG. 3 is a block diagram of a number of components that may be incorporated in the gaming unit 20. Referring to FIG. 3, the gaming unit 20 may include a controller 100 that may comprise a program memory 102, a microcontroller or microprocessor (MP) 104, a random-access memory (RAM) 106 and an input/output (I/O) circuit 108, all of which may be interconnected via an address/data bus 110. It should be appreciated that although only one microprocessor 104 is shown, the controller 100 may include multiple microprocessors 104. Similarly, the memory of the controller 100 may include multiple RAMs 106 and multiple program memories 102. Although the I/O circuit 108 is shown as a single block, it should be appreciated that the I/O circuit 108 may include a number of different types of I/O circuits. The RAM(s) 104 and program memories 102 may be implemented as semiconductor memories, magnetically readable memories, and/or optically readable memories, for example.

FIG. 3 illustrates that the control panel 66, the coin acceptor 52, the bill acceptor 54, the card reader 58 and the ticket reader/printer 56 may be operatively coupled to the I/O circuit 108, each of those components being so coupled by either a unidirectional or bidirectional, single-line or multiple-line data link, which may depend on the design of the component that is used. The speaker(s) 62 may be operatively coupled to a sound circuit 112, that may comprise a voice- and sound-synthesis circuit or that may comprise a driver circuit. The sound-generating circuit 112 may be coupled to the I/O circuit 108.

As shown in FIG. 3, the components 52, 54, 56, 58, 66, 112 may be connected to the I/O circuit 108 via a respective direct line or conductor. Different connection schemes could be used. For example, one or more of the components shown in FIG. 3 may be connected to the I/O circuit 108 via a common bus or other data link that is shared by a number of components. Furthermore, some of the components may be directly connected to the microprocessor 104 without passing through the I/O circuit 108.

Overall Operation of Gaming Unit

One manner in which one or more of the gaming units 20 (and one or more of the gaming units 30) may operate is described below in connection with a number of flowcharts which represent a number of portions or routines of one or more computer programs, which may be stored in one or more of the memories of the controller 100. The computer program(s) or portions thereof may be stored remotely, outside of the gaming unit 20, and may control the operation of the gaming unit 20 from a remote location. Such remote control may be facilitated with the use of a wireless connection, or by an Internet interface that connects the gaming unit 20 with a remote computer (such as one of the network computers 22, 32) having a memory in which the computer program portions are stored. The computer program portions may be written in any high level language such as C, C+, C++ or the like or any low-level, assembly or machine language. By storing the computer program portions therein, various portions of the memories 102, 106 are physically and/or structurally configured in accordance with computer program instructions.

Figure 4:
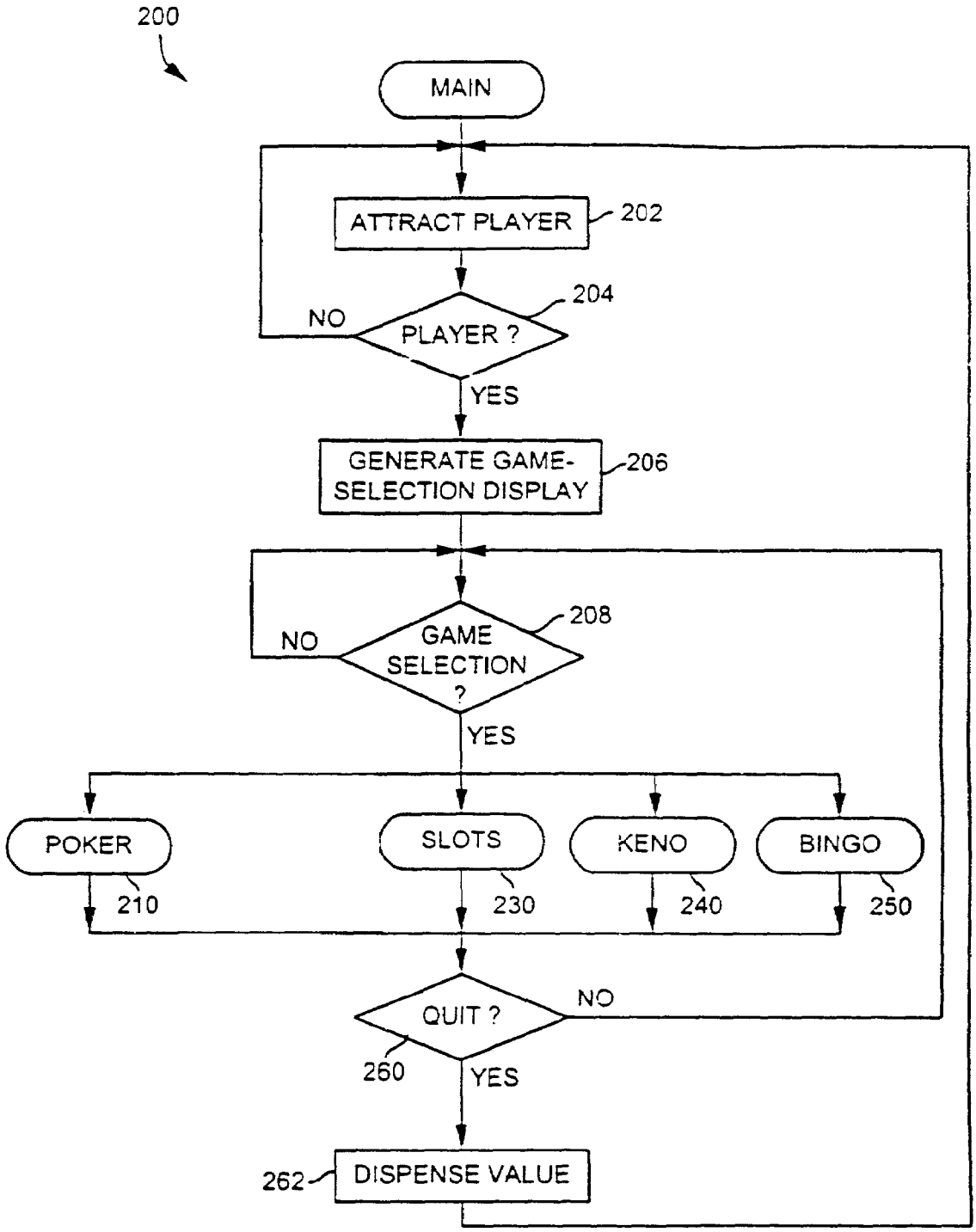
FIG. 4 is a flowchart of an embodiment of a main routine that may be performed during operation of one or more of the gaming units.

FIG. 4 is a flowchart of a main operating routine 200 that may be stored in the memory of the controller 100. Referring to FIG. 4, the main routine 200 may begin operation at block 202 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62. The attraction sequence may include a scrolling list of games that may be played on the gaming unit 20 and/or video images of various games being played, such as video poker, video slots, video keno, video bingo, etc.

During performance of the attraction sequence, if a potential player makes any input to the gaming unit 20 as determined at block 204, the attraction sequence may be terminated and a game-selection display may be generated on the display unit 70 at block 206 to allow the player to select a game available on the gaming unit 20. The gaming unit 20 may detect an input at block 204 in various ways. For example, the gaming unit 20 could detect if the player presses any button on the gaming unit 20; the gaming unit 20 could determine if the player deposited one or more coins into the gaming unit 20; the gaming unit 20 could determine if player deposited paper currency into the gaming unit; etc.

The game-selection display generated at block 206 may include, for example, a list of video games that may be played on the gaming unit 20 and/or a visual message to prompt the player to deposit value into the gaming unit 20. While the game-selection display is generated, the gaming unit 20 may wait for the player to make a game selection. Upon selection of one of the games by the player as determined at block 208, the controller 100 may cause one of a number of game routines to be performed to allow the selected game to be played. For example, the game routines could include a video poker routine 210, a slots routine 230, a video keno routine 240, and a video bingo routine 250. At block 208, if no game selection is made within a given period of time, the operation may branch back to block 202.

After one of the routines 210, 230, 240, 250 has been performed to allow the player to play one of the games, block 260 may be utilized to determine whether the player wishes to terminate play on the gaming unit 20 or to select another game. If the player wishes to stop playing the gaming unit 20, which wish may be expressed, for example, by selecting a "Cash Out" button, the controller 100 may dispense value to the player at block 262 based on the outcome of the game(s) played by the player. The operation may then return to block 202. If the player did not wish to quit as determined at block 260, the routine may return to block 208 where the game-selection display may again be generated to allow the player to select another game.

It should be noted that although five gaming routines are shown in FIG. 4, a different number of routines could be included to allow play of a different number of games. The gaming unit 20 may also be programmed to allow play of different games.

Figure 5:
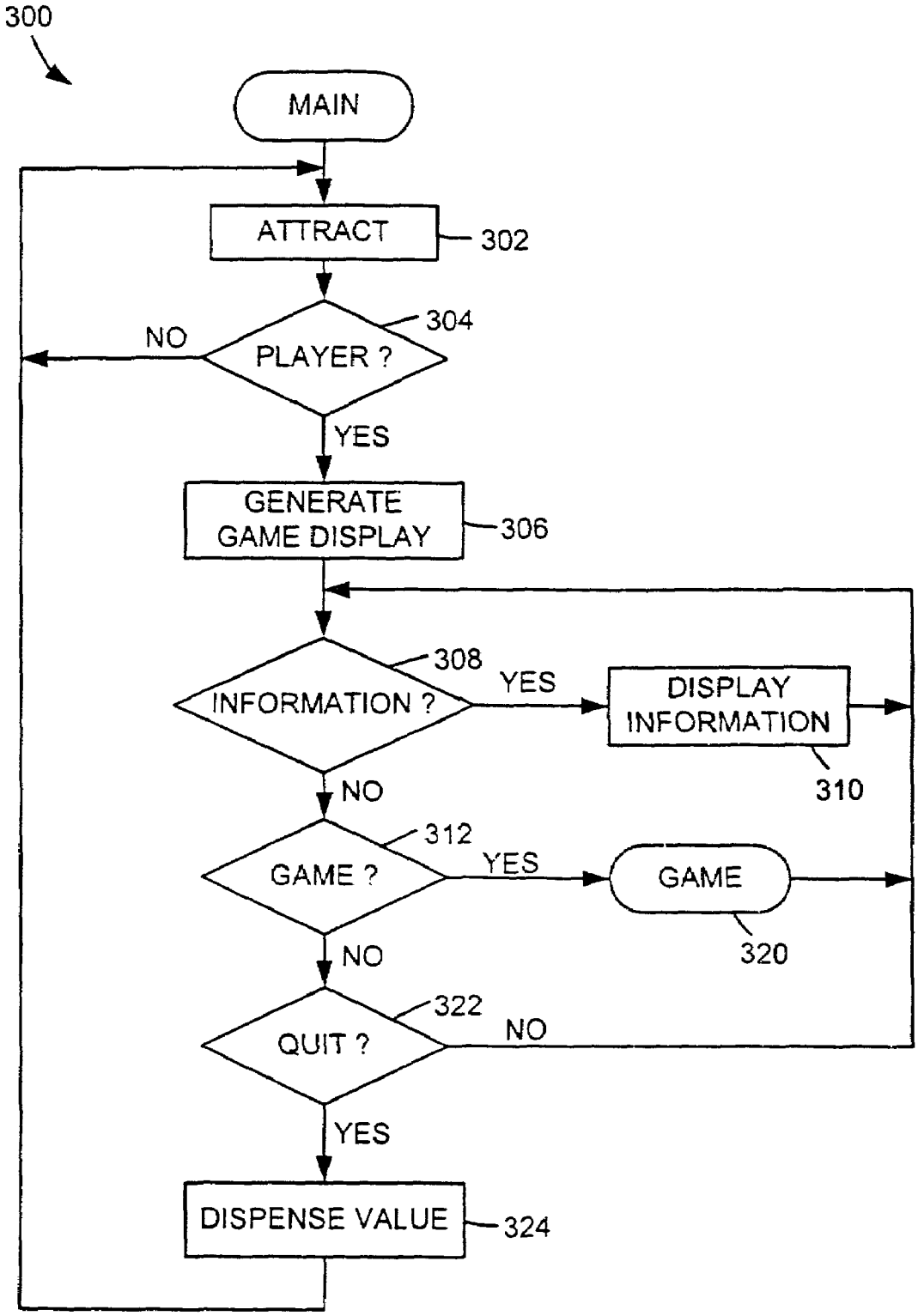
FIG. 5 is a flowchart of an embodiment of a subroutine that may be performed during operation of one or more of the gaming units.

FIG. 5 is a flowchart of an alternative main operating routine 300 that may be stored in the memory of the controller 100. The main routine 300 may be utilized for gaming units 20 that are designed to allow play of only a single game or single type of game. Referring to FIG. 5, the main routine 300 may begin operation at block 302 during which an attraction sequence maybe performed in an attempt to induce a potential player in a casino to play the gaming unit 20. The attraction sequence may be performed by displaying one or more video images on the display unit 70 and/or causing one or more sound segments, such as voice or music, to be generated via the speakers 62.

During performance of the attraction sequence, if a potential player makes any input to the gaming unit 20 as determined at block 304, the attraction sequence may be terminated and a game display may be generated on the display unit 70 at block 306. The game display generated at block 306 may include, for example, an image of the casino game that may be played on the gaming unit 20 and/or a visual message to prompt the player to deposit value into the gaming unit 20. At block 308, the gaming unit 20 may determine if the player requested information concerning the game, in which case the requested information may be displayed at block 310. Block 312 may be used to determine if the player requested initiation of a game, in which case a game routine 320 may be performed. The game routine 320 could be any one of the game routines disclosed herein, such as one of the five game routines 210, 230, 240, 250, or another game routine.

After the routine 320 has been performed to allow the player to play the game, block 322 may be utilized to determine whether the player wishes to terminate play on the gaming unit 20. If the player wishes to stop playing the gaming unit 20, which wish may be expressed, for example, by selecting a "Cash Out" button, the controller 100 may dispense value to the player at block 324 based on the outcome of the game(s) played by the player. The operation may then return to block 302. If the player did not wish to quit as determined at block 322, the program may branch back to block 308.

Explanation Subroutine

Figure 5A:
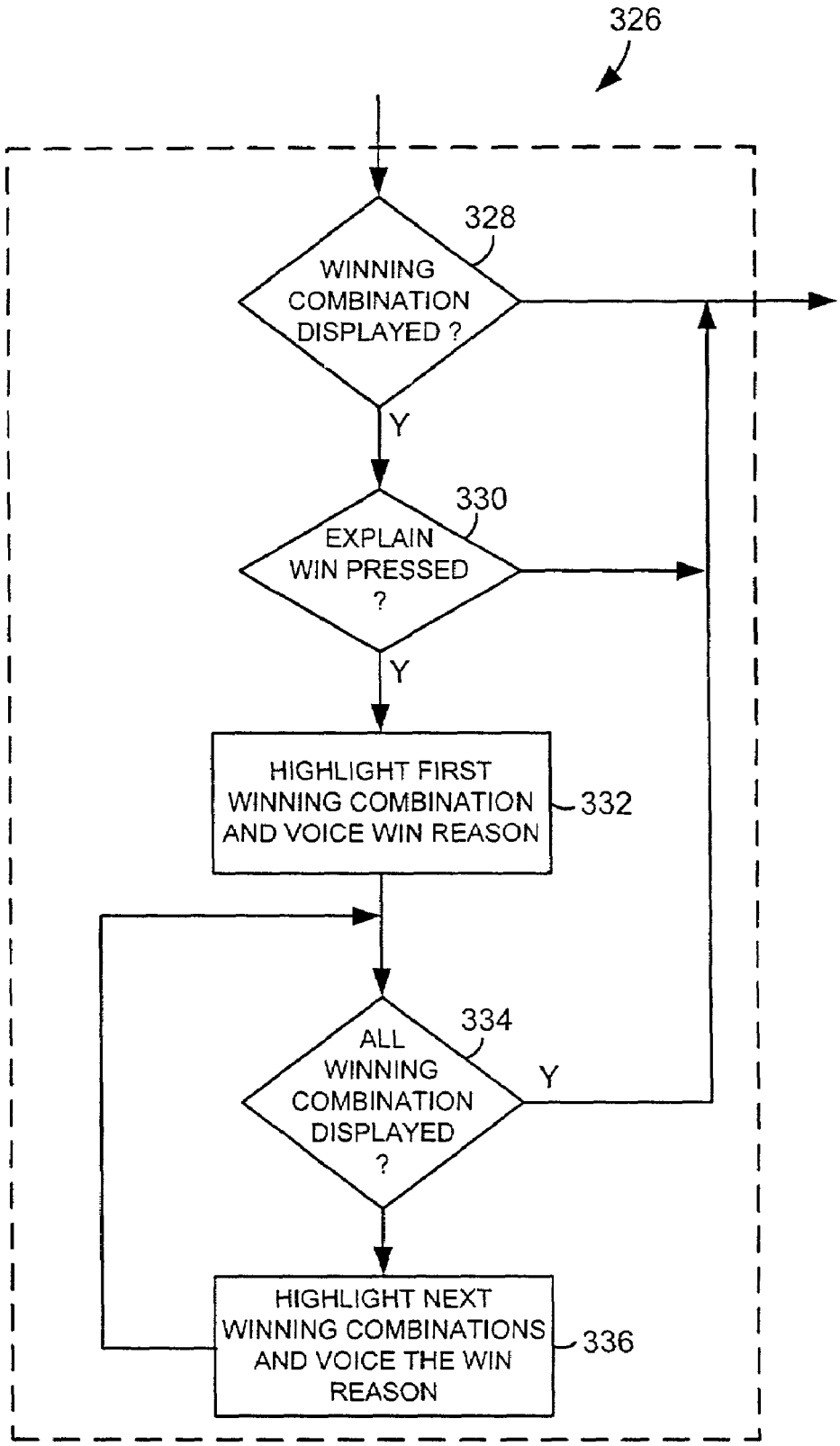
FIG. 5A is a flowchart of an alternative embodiment of a subroutine that may be performed during operation of one or more of the gaming units.
Figure 5B:
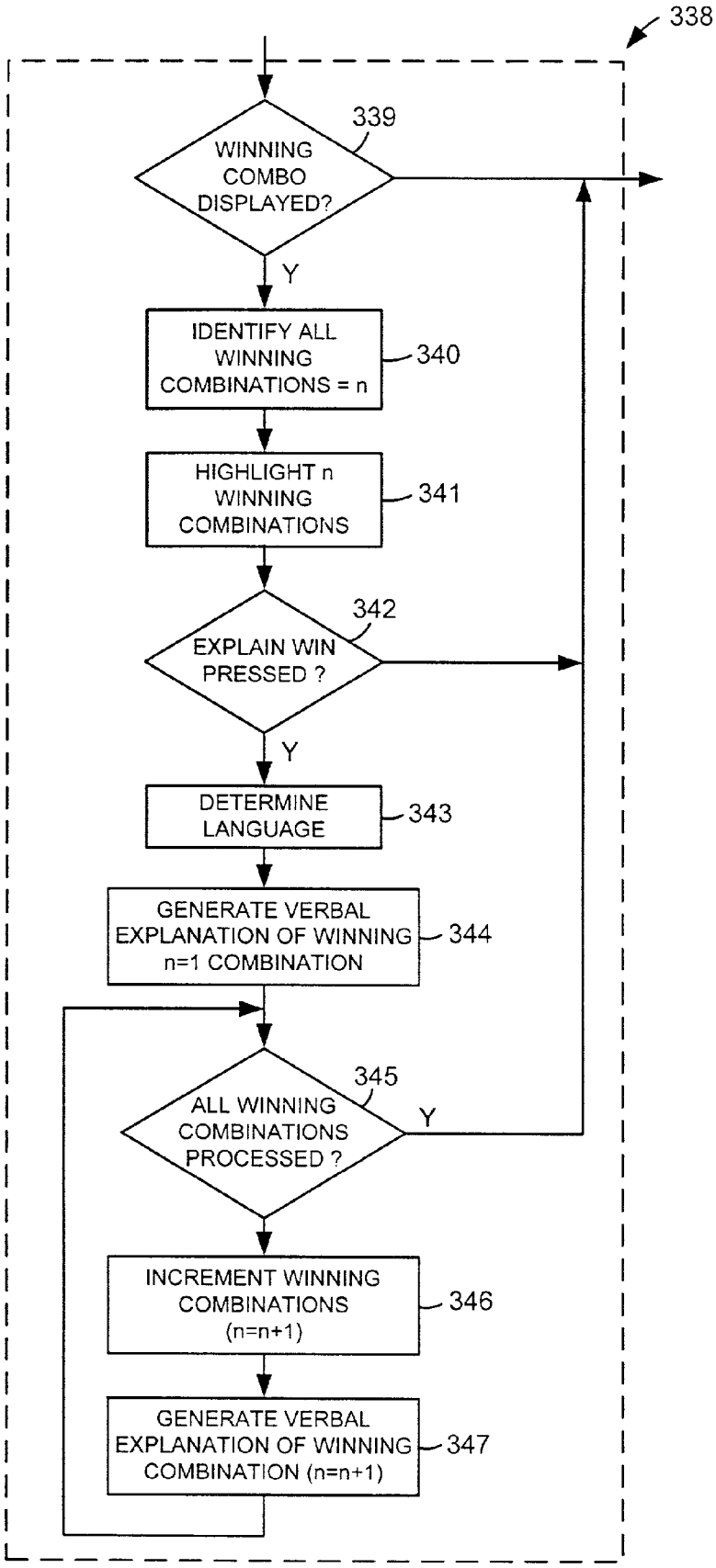
FIG. 5B is a flowchart of an alternative embodiment of a main routine that may be performed during operation of one or more of the gaming units.

FIG. 5A and 5B are flow charts of different embodiments of a pair of explanation subroutines 326, 338 (respectively) that maybe incorporated into any of the casino game routines 210, 230, 240, 250 that utilizes stored payout data to determine the magnitude of the total payout value. Referring to FIG. 5A, the general explanation subroutine 326 may begin at block 328 by determining if a winning combination has been awarded to the player. At block 330, the subroutine may determine if the player has requested an explanation of the winning combination(s), such as by activating the "Explain Pays" button 73, 359, 459, 529, 607. At block 332, the routine may highlight the first winning combination and may generate a explanation of how this combination contributed to the total payout value for the round, based on the payout information stored within the controller 100. At block 334, the routine may determine if all the winning combinations have been highlighted and explained to the player. If there are winning combinations remaining, at block 336, the routine may highlight and explain the next winning combination and may generate an explanation for the player, this portion of the subroutine is capable of repeating itself until all the remaining winning combinations have been individually highlighted and an explanation of the combination's contribution to the total payout value has been generated.

Referring now to FIG. 5B, the flowchart depicted therein illustrates the explanation subroutine 338, which contains additional options and features compatible with the gaming routines 210, 230, 240, 250. The explanation subroutine 338 of FIG. 5B is activated, at block 339, when a number of winning combinations are awarded to the player. At block 340, the total number of winning combinations are identified and that value is assigned to a variable, identified as the variable "n" in the flowchart. At block 341, the subroutine may sequentially identify and highlight each of the winning combinations awarded to the player. For example, each of the winning combinations may be highlighted with a different colored border; each winning combination may be highlighted individually based on the magnitude of the payout value defined in the stored payout data, or the winning combinations may be identified simultaneously to indicate the total number of winning combinations contributed to the total payout value. At block 342, the subroutine is capable of determining whether the player has requested an additional payout explanation, such as by activating an "Explain Pays" button such as the button 73 shown in FIG. 2A. At block 343 the routine may attempt to determine the language in which the player prefers to converse, to determine in which language the explanation should be generated. This determination maybe accomplished, for example, by using player information gathered through the card reader 58, by prompting the player on the color video display unit 70 to make a language selection or by simply utilizing a present machine configuration. At block 344, the subroutine may generate a verbal or audio explanation of the winning combination, in the desired language. The explanation may be a voice congratulating and explaining the contents of the stored payout data or paytable to the player, or it may be an audible indicator designed to associate the proper paytable combination with the winning combination awarded the player. At block 345, the subroutine may determine if the number of winning combinations explained to the player equals the total number of winning combinations "n", if not, at block 346 the variable "n" is incremented. At block 347, the routine may generate an explanation appropriate for the "n+1" winning combination for the player, this process repeats itself until all the winning combinations have been explained to the user, at which point the subroutine passes control back to the main casino gambling routines 210, 230, 240, 250.

Video Poker

Figure 6:
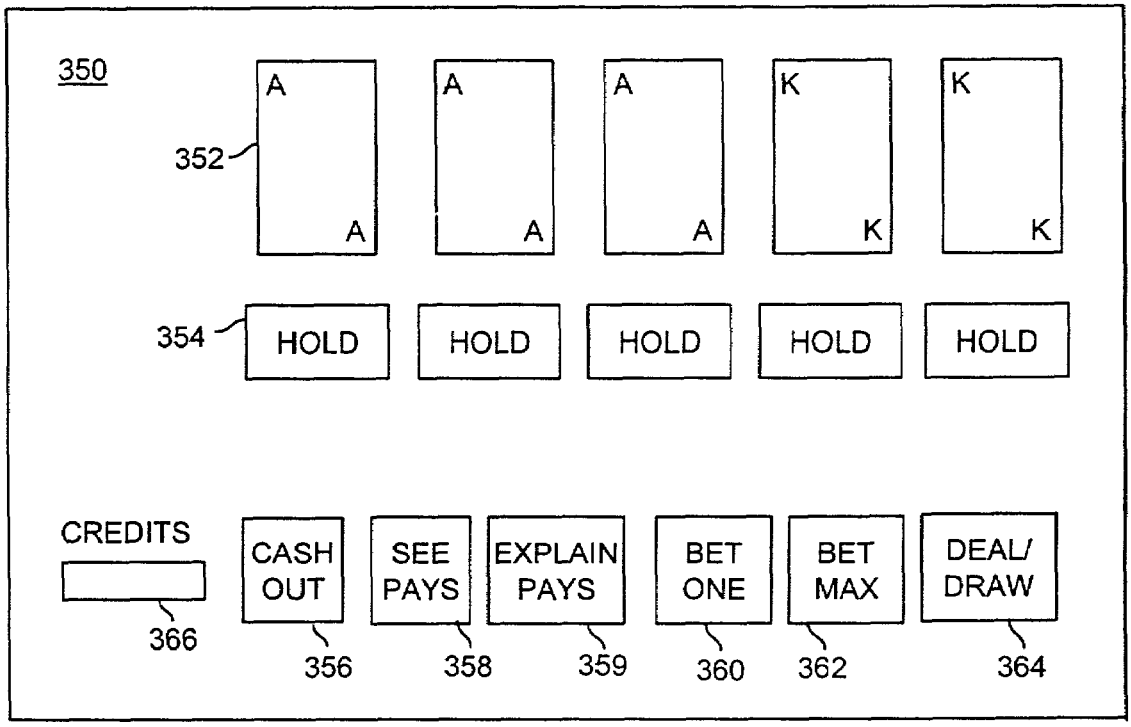
FIG. 6 is an illustration of an embodiment of a visual display that may be displayed during performance of the video poker routine of FIG. 7.

FIG. 6 is an exemplary display 350 that may be shown on the display unit 70 during performance of the video poker routine 210 shown schematically in FIG. 4. Referring to FIG. 6, the display 350 may include video images 352 of a plurality of playing cards representing the player's hand, such as five cards. To allow the player to control the play of the video poker game, a plurality of player-selectable buttons may be displayed. The buttons may include a "Hold" button 354 disposed directly below each of the playing card images 352, a "Cash Out" button 356, a "See Pays" button 358, a "Explain Pays" button 359, a "Bet One Credit" button 360, a "Bet Max Credits" button 362, and a "Deal/Draw" button 364. The display 350 may also include an area 366 in which the number of remaining credits or value is displayed. If the display unit 70 is provided with a touch-sensitive screen, the buttons 354, 356, 358, 360, 362, 364 may form part of the video display 350. Alternatively, one or more of those buttons may be provided as part of a control panel that is provided separately from the display unit 70.

Figure 7:
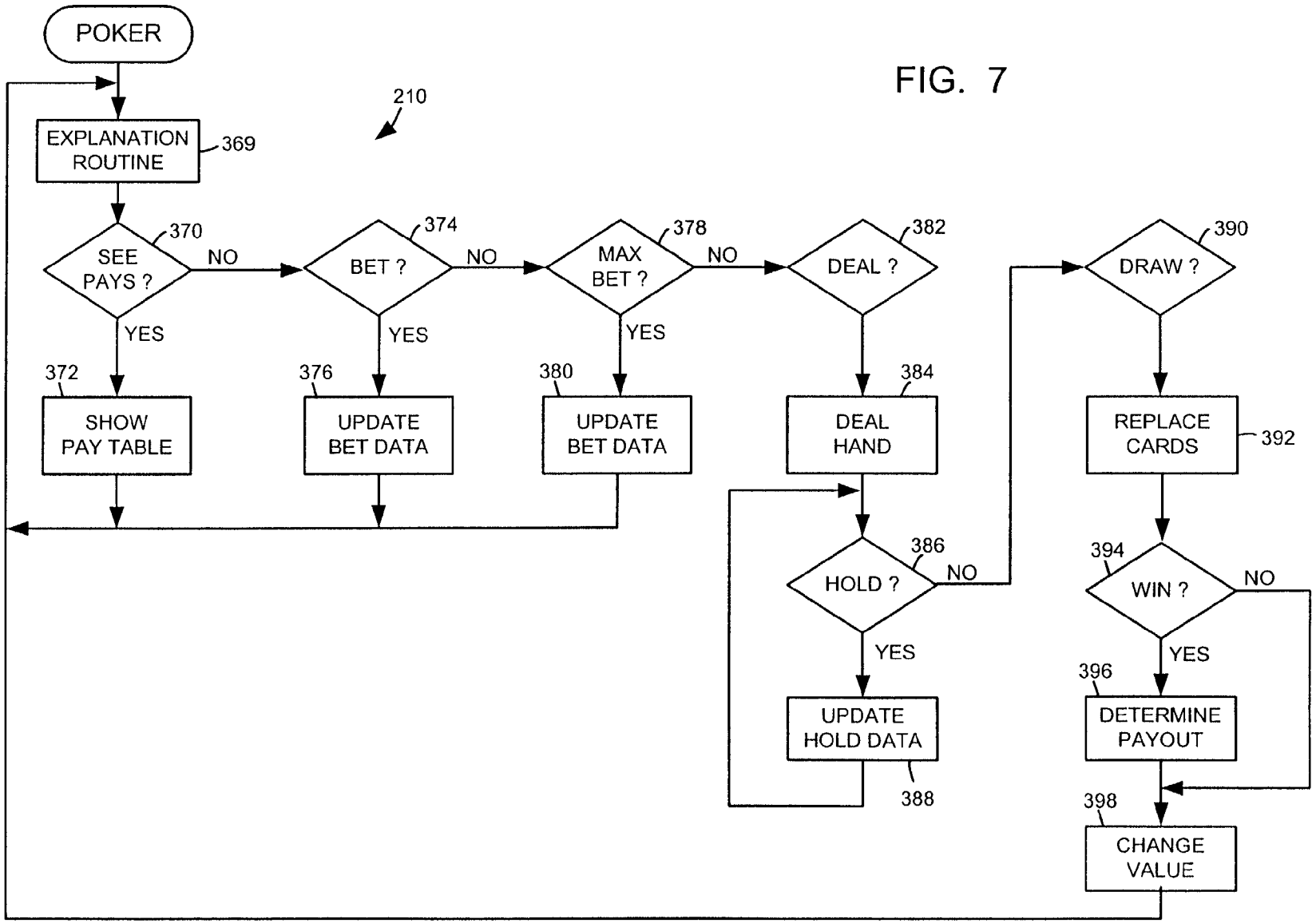
FIG. 7 is a flowchart of an embodiment of a video poker routine that may be performed by one or more of the gaming units.

FIG. 7 is a flowchart of the video poker routine 210 shown schematically in FIG. 4. Referring to FIG. 7, at block 369, an explanation routine maybe performed, which may be the same as or similar to one of the explanation routines 326, 338 described above. At block 370, the routine may determine whether the player has requested payout information, such as by activating the "See Pays" button 358, in which case at block 372 the routine may cause one or more pay tables to be displayed on the display unit 70. At block 374, the routine may determine whether the player has made a bet, such as by pressing the "Bet One Credit" button 360, in which case at block 376 bet data corresponding to the bet made by the player may be stored in the memory of the controller 100. At block 378, the routine may determine whether the player has pressed the "Bet Max Credits" button 362, in which case at block 380 bet data corresponding to the maximum allowable bet may be stored in the memory of the controller 100.

At block 382, the routine may determine if the player desires a new hand to be dealt, which maybe determined by detecting if the "Deal/Draw" button 364 was activated after a wager was made. In that case, at block 384 a video poker hand may be "dealt" by causing the display unit 70 to generate the playing card images 352. After the hand is dealt, at block 386 the routine may determine if any of the "Hold" buttons 354 have been activated by the player, in which case data regarding which of the playing card images 352 are to be "held" maybe stored in the controller 100 at block 388. If the "Deal/Draw" button 364 is activated again as determined at block 390, each of the playing card images 352 that was not "held" may be caused to disappear from the video display 350 and to be replaced by a new, randomly selected, playing card image 352 at block 392.

At block 394, the routine may determine whether the poker hand represented by the playing card images 352 currently displayed is a winner. That determination may be made by comparing data representing the currently displayed poker hand with data representing all possible winning hands, which may be stored in the memory of the controller 100. If there is a winning hand, a payout value corresponding to the winning hand may be determined at block 396. At block 398, the player's cumulative value or number of credits may be updated by subtracting the bet made by the player and adding, if the hand was a winner, the payout value determined at block 396. The cumulative value or number of credits may also be displayed in the display area 366 (FIG. 6).

Although the video poker routine 210 is described above in connection with a single poker hand of five cards, the routine 210 may be modified to allow other versions of poker to be played. For example, seven card poker may be played, or stud poker may be played. Alternatively, multiple poker hands may be simultaneously played. In that case, the game may begin by dealing a single poker hand, and the player may be allowed to hold certain cards. After deciding which cards to hold, the held cards may be duplicated in a plurality of different poker hands, with the remaining cards for each of those poker hands being randomly determined.

Slots

FIG. 8 is an exemplary display 450 that may be shown on the display unit 70 during performance of the slots routine 230 shown schematically in FIG. 4. Referring to FIG. 8, the display 450 may include video images 452 of a plurality of slot machine reels, each of the reels having a plurality of reel symbols 454 associated therewith. Although the display 450 shows five reel images 452, each of which may have three reel symbols 454 that are visible at a time, other reel configurations could be utilized.

To allow the player to control the play of the slots game, a plurality of player-selectable buttons may be displayed. The buttons may include a "Cash Out" button 456, a "See Pays" button 458, a "Explain Pays" button 459, a plurality of payline-selection buttons 460 each of which allows the player to select a different number of paylines prior to "spinning" the reels, a plurality of bet-selection buttons 462 each of which allows a player to specify a wager amount for each payline selected, a "Spin" button 464, and a "Max Bet" button 466 to allow a player to make the maximum wager allowable.

Figure 10:
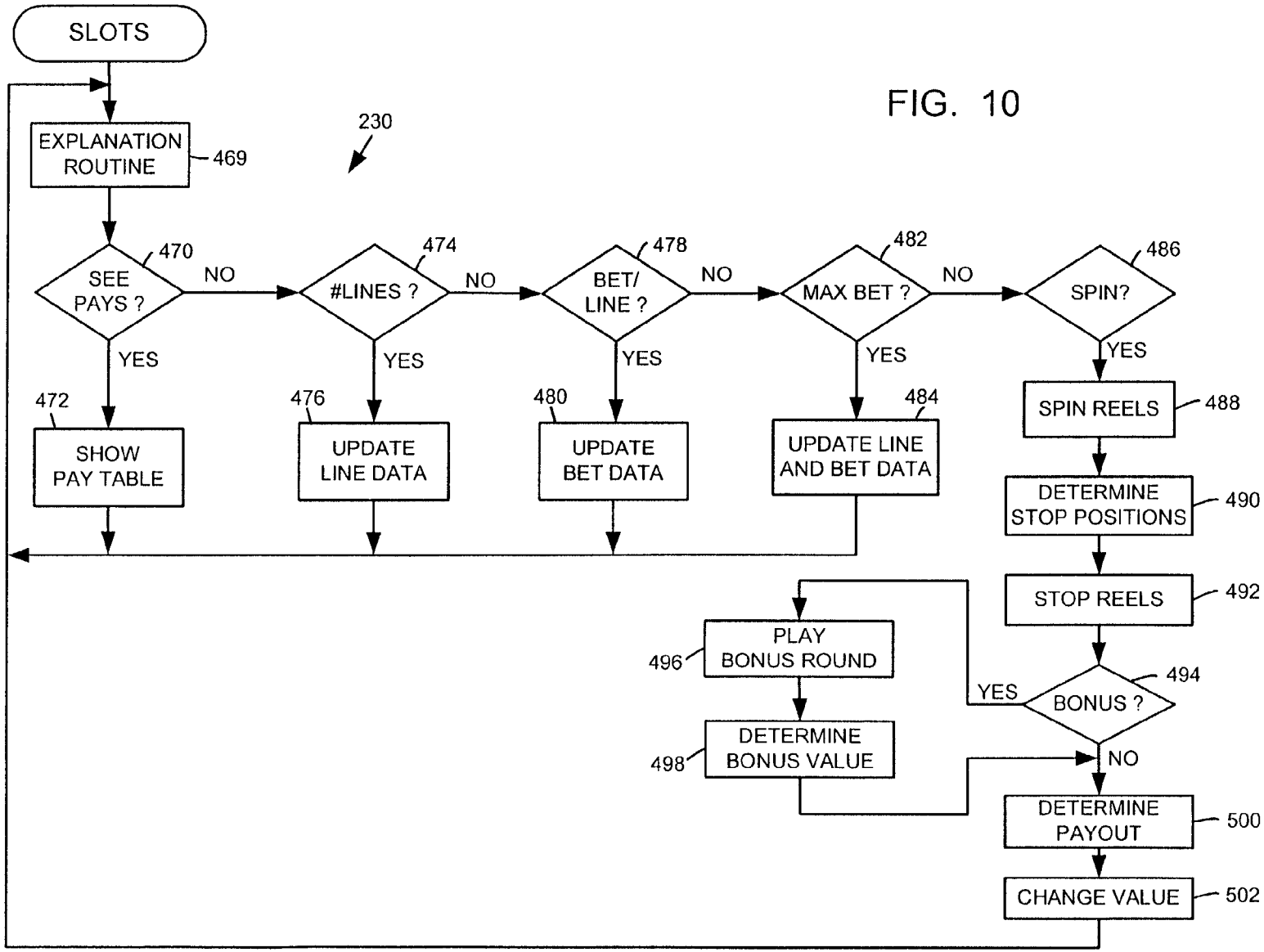
FIG. 10 is a flowchart of an embodiment of a slots routine that may be performed by one or more of the gaming units.

FIG. 10 is a flowchart of the slots routine 230 shown schematically in FIG. 10. Referring to FIG. 10, at block 469, an explanation routine may be performed, which may be the same as or similar to one of the explanation routines 326, 338 described above. At block 470, the routine may determine whether the player has requested payout information, such as by activating the "See Pays" button 458, in which case at block 472 the routine may cause one or more pay tables to be displayed on the display unit 70. At block 474, the routine may determine whether the player has pressed one of the payline-selection buttons 460, in which case at block 476 data corresponding to the number of paylines selected by the player may be stored in the memory of the controller 100. At block 478, the routine may determine whether the player has pressed one of the bet-selection buttons 462, in which case at block 480 data corresponding to the amount bet per payline may be stored in the memory of the controller 100. At block 482, the routine may determine whether the player has pressed the "Max Bet" button 466, in which case at block 484 bet data (which may include both payline data and bet-per-payline data) corresponding to the maximum allowable bet may be stored in the memory of the controller 100.

If the "Spin" button 464 has been activated by the player as determined at block 486, at block 488 the routine may cause the slot machine reel images 452 to begin "spinning" so as to simulate the appearance of a plurality of spinning mechanical slot machine reels. At block 490, the routine may determine the positions at which the slot machine reel images will stop, or the particular symbol images 454 that will be displayed when the reel images 452 stop spinning. At block 492, the routine may stop the reel images 452 from spinning by displaying stationary reel images 452 and images of three symbols 454 for each stopped reel image 452. The virtual reels may be stopped from left to right, from the perspective of the player, or in any other manner or sequence.

The routine may provide for the possibility of a bonus game or round if certain conditions are met, such as the display in the stopped reel images 452 of a particular symbol 454. If there is such a bonus condition as determined at block 494, the routine may proceed to block 496 where a bonus round may be played. The bonus round may be a different game than slots, and many other types of bonus games could be provided. If the player wins the bonus round, or receives additional credits or points in the bonus round, a bonus value may be determined at block 498. A payout value corresponding to outcome of the slots game and/or the bonus round may be determined at block 500. At block 502, the player's cumulative value or number of credits may be updated by subtracting the bet made by the player and adding, if the slot game and/or bonus round was a winner, the payout value determined at block 500.

Although the above routine has been described as a virtual slot machine routine in which slot machine reels are represented as images on the display unit 70, actual slot machine reels that are capable of being spun may be utilized instead.

Video Keno

FIG. 9 is an exemplary display 520 that may be shown on the display unit 70 during performance of the video keno routine 240 shown schematically in FIG. 4. Referring to FIG. 9, the display 520 may include a video image 522 of a plurality of numbers that were selected by the player prior to the start of a keno game and a video image 524 of a plurality of numbers randomly selected during the keno game. The randomly selected numbers may be displayed in a grid pattern.

To allow the player to control the play of the keno game, a plurality of player-selectable buttons may be displayed. The buttons may include a "Cash Out" button 526, a "See Pays" button 528, a "Explain Pays" button 529, a "Bet One Credit" button 530, a "Bet Max Credits" button 532, a "Select Ticket" button 534, a "Select Number" button 536, and a "Play" button 538. The display 520 may also include an area 540 in which the number of remaining credits or value is displayed. If the display unit 70 is provided with a touch-sensitive screen, the buttons may form part of the video display 520. Alternatively, one or more of those buttons may be provided as part of a control panel that is provided separately from the display unit 70.

Figure 11:
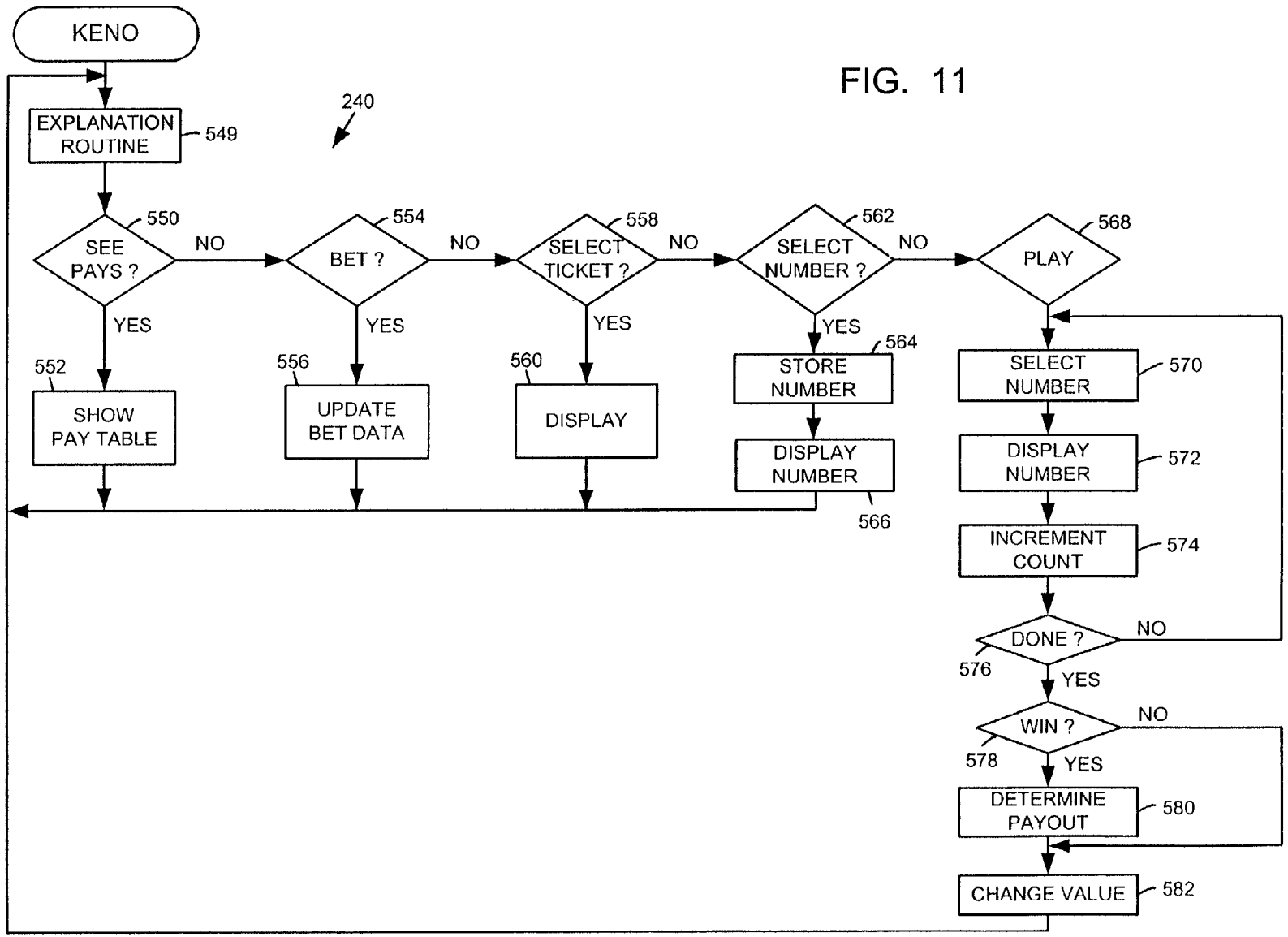
FIG. 11 is a flowchart of an embodiment of a video keno routine that may be performed by one or more of the gaming units.

FIG. 11 is a flowchart of the video keno routine 240 shown schematically in FIG. 4. The keno routine 240 may be utilized in connection with a single gaming unit 20 where a single player is playing a keno game, or the keno routine 340 may be utilized in connection with multiple gaming units 20 where multiple players are playing a single keno game. In the latter case, one or more of the acts described below may be performed either by the controller 100 in each gaming unit or by one of the network computer 22, 32 to which multiple gaming units 20 are operatively connected.

Referring to FIG. 11, at block 549, an explanation routine may be performed, which may be the same as or similar to one of the explanation routines 326, 338 described above. At block 550, the routine may determine whether the player has requested payout information, such as by activating the "See Pays" button 528, in which case at block 552 the routine may cause one or more pay tables to be displayed on the display unit 70. At block 554, the routine may determine whether the player has made a bet, such as by having pressed the "Bet One Credit" button 530 or the "Bet Max Credits" button 532, in which case at block 556 bet data corresponding to the bet made by the player may be stored in the memory of the controller 100. After the player has made a wager, at block 558 the player may select a keno ticket, and at block 560 the ticket may be displayed on the display 520. At block 562, the player may select one or more game numbers, which may be within a range set by the casino. After being selected, the player's game numbers may be stored in the memory of the controller 100 at block 564 and may be included in the image 522 on the display 520 at block 566. After a certain amount of time, the keno game may be closed to additional players (where a number of players are playing a single keno game using multiple gambling units 20).

If play of the keno game is to begin as determined at block 568, at block 570 a game number within a range set by the casino may be randomly selected either by the controller 100 or a central computer operatively connected to the controller, such as one of the network computers 22, 32. At block 572, the randomly selected game number may be displayed on the display unit 70 and the display units 70 of other gaming units 20 (if any) which are involved in the same keno game. At block 574, the controller 100 (or the central computer noted above) may increment a count which keeps track of how many game numbers have been selected at block 570.

At block 576, the controller 100 (or one of the network computers 22, 32) may determine whether a maximum number of game numbers within the range have been randomly selected. If not, another game number may be randomly selected at block 570. If the maximum number of game numbers has been selected, at block 578 the controller 100 (or a central computer) may determine whether there are a sufficient number of matches between the game numbers selected by the player and the game numbers selected at block 570 to cause the player to win. The number of matches may depend on how many numbers the player selected and the particular keno rules being used.

If there are a sufficient number of matches, a payout may be determined at block 580 to compensate the player for winning the game. The payout may depend on the number of matches between the game numbers selected by the player and the game numbers randomly selected at block 570. At block 582, the player's cumulative value or number of credits may be updated by subtracting the bet made by the player and adding, if the keno game was won, the payout value determined at block 580. The cumulative value or number of credits may also be displayed in the display area 540 (FIG. 9).

Video Bingo

Figure 12:
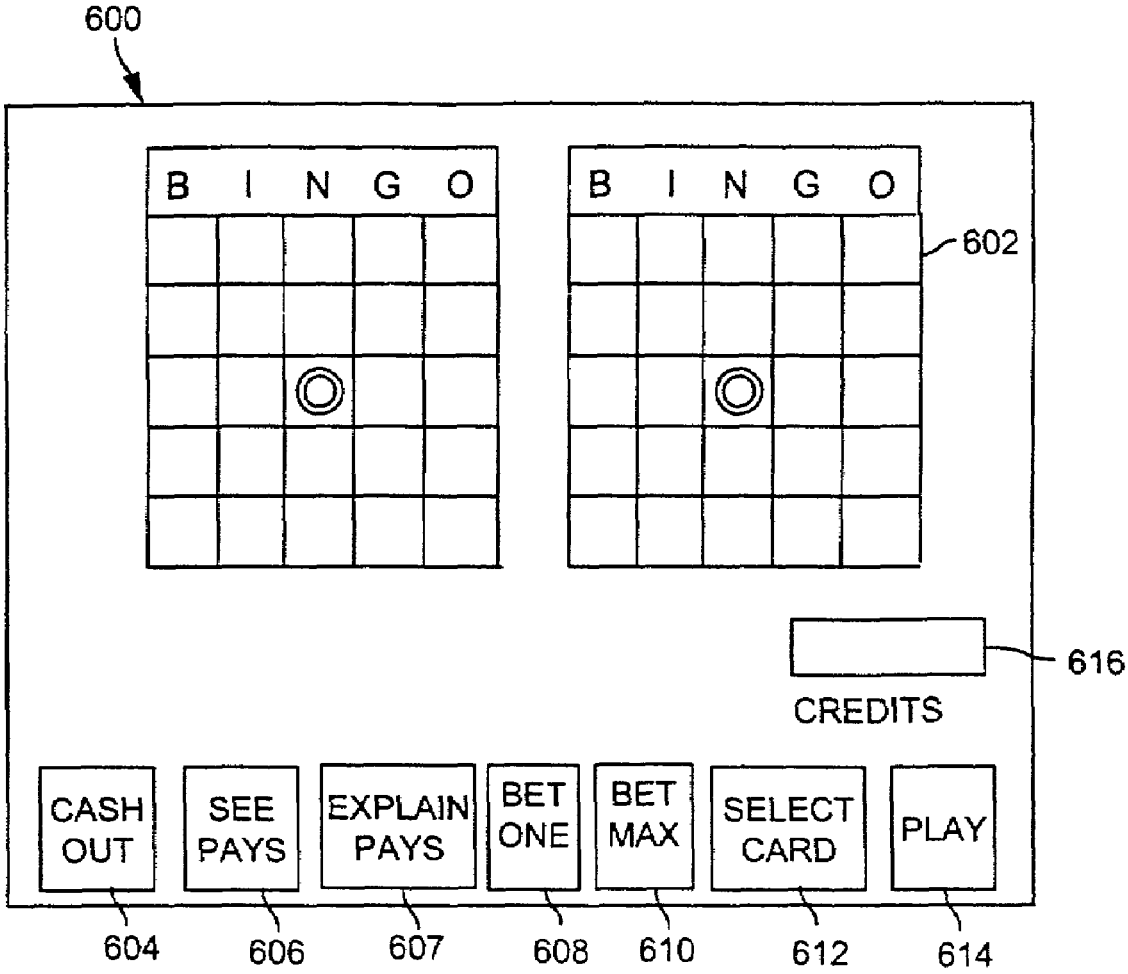
FIG. 12 is an illustration of an embodiment of a visual display that may be displayed during performance of the video bingo routine of FIG. 13.

FIG. 12 is an exemplary display 600 that may be shown on the display unit 70 during performance of the video bingo routine 250 shown schematically in FIG. 4. Referring to FIG. 12, the display 600 may include one or more video images 602 of a bingo card and images of the bingo numbers selected during the game. The bingo card images 602 may have a grid pattern.

To allow the player to control the play of the bingo game, a plurality of player-selectable buttons may be displayed. The buttons may include a "Cash Out" button 604, a "See Pays" button 606, a "Explain Pays" button 607, a "Bet One Credit" button 608, a "Bet Max Credits" button 610, a "Select Card" button 612, and a "Play" button 614. The display 600 may also include an area 616 in which the number of remaining credits or value is displayed. If the display unit 70 is provided with a touch-sensitive screen, the buttons may form part of the video display 600. Alternatively, one or more of those buttons may be provided as part of a control panel that is provided separately from the display unit 70.

Figure 13:
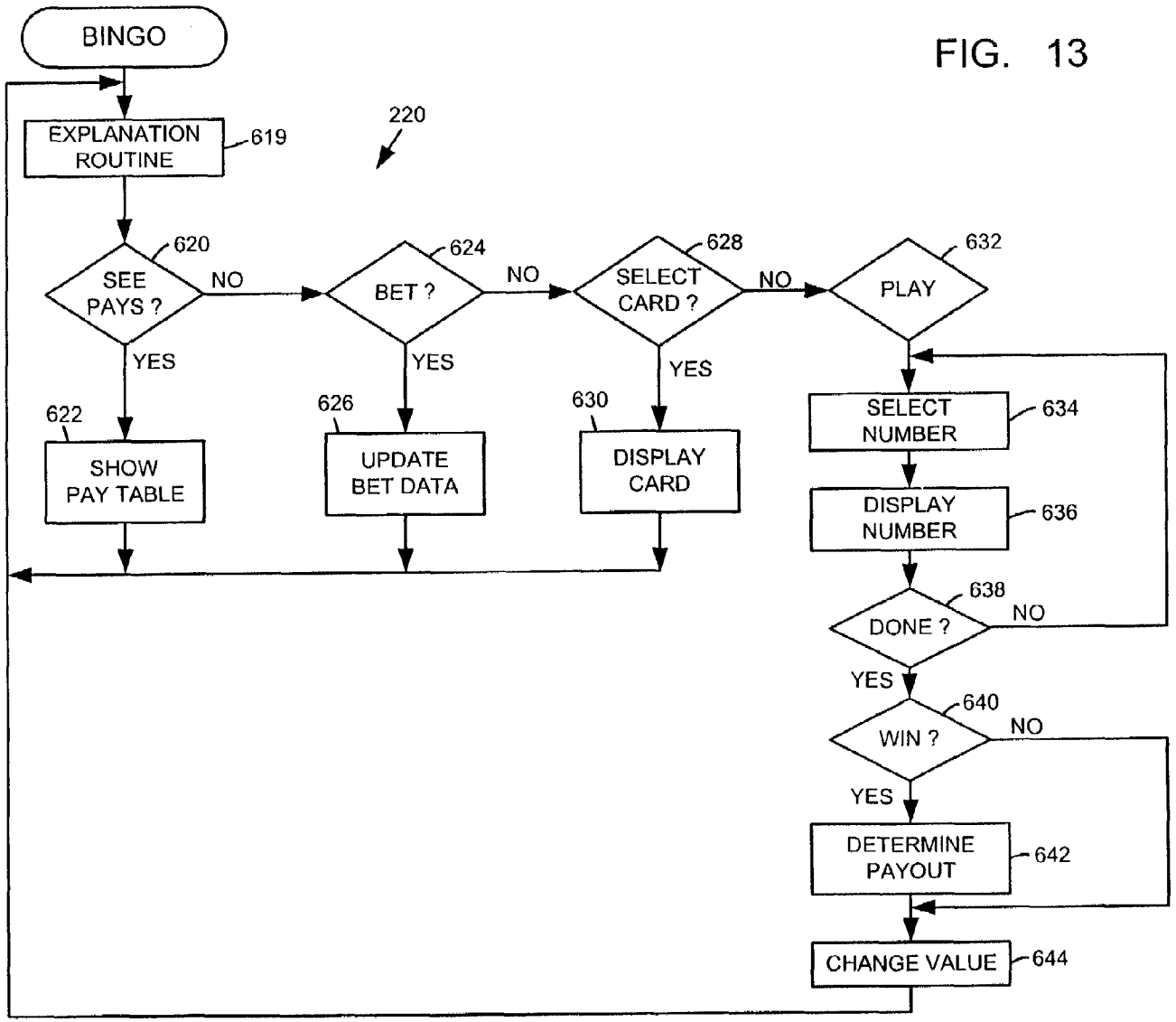
FIG. 13 is a flowchart of an embodiment of a video bingo routine that may be performed by one or more of the gaming units.

FIG. 13 is a flowchart of the video bingo routine 250 shown schematically in FIG. 4. The bingo routine 250 may be utilized in connection with a single gaming unit 20 where a single player is playing a bingo game, or the bingo routine 250 may be utilized in connection with multiple gaming units 20 where multiple players are playing a single bingo game. In the latter case, one or more of the acts described below may be performed either by the controller 100 in each gaming unit 20 or by one of the network computers 22, 32 to which multiple gaming units 20 are operatively connected.

Referring to FIG. 13, at block 619, an explanation routine may be performed, which may be the same as or similar to one of the explanation routines 326, 338 described above. At block 620, the routine may determine whether the player has requested payout information, such as by activating the "See Pays" button 606, in which case at block 622 the routine may cause one or more pay tables to be displayed on the display unit 70. At block 624, the routine may determine whether the player has made a bet, such as by having pressed the "Bet One Credit" button 608 or the "Bet Max Credits" button 610, in which case at block 626 bet data corresponding to the bet made by the player may be stored in the memory of the controller 100.

After the player has made a wager, at block 628 the player may select a bingo card, which may be generated randomly. The player may select more than one bingo card, and there may be a maximum number of bingo cards that a player may select. After play is to commence as determined at block 632, at block 634 a bingo number may be randomly generated by the controller 100 or a central computer such as one of the network computers 22, 32. At block 636, the bingo number may be displayed on the display unit 70 and the display units 70 of any other gaming units 20 involved in the bingo game.

At block 638, the controller 100 (or a central computer) may determine whether any player has won the bingo game. If no player has won, another bingo number may be randomly selected at block 634. If any player has bingo as determined at block 638, the routine may determine at block 640 whether the player playing that gaming unit 20 was the winner. If so, at block 642 a payout for the player may be determined. The payout may depend on the number of random numbers that were drawn before there was a winner, the total number of winners (if there was more than one player), and the amount of money that was wagered on the game. At block 644, the player's cumulative value or number of credits may be updated by subtracting the bet made by the player and adding, if the bingo game was won, the payout value determined at block 642. The cumulative value or number of credits may also be displayed in the display area 616 (FIG. 12).

Numerous modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A gaming apparatus, comprising:

a display unit to generate video images;

a value input device;

a controller operatively coupled to said display unit and said value input device, said controller comprising a processor and a memory operatively coupled to said processor, said controller being programmed to allow a person to make at least one wager, said controller being programmed to cause a video image to be generated on said display unit, said video image representing a game, said game being one of the following games: video poker, video slots, video keno and video bingo, said video image comprising an image of at least five playing cards if said game comprises video poker, said video image comprising an image of a plurality of simulated slot machine reels if said game comprises video slots, said video image comprising an image of a plurality of keno numbers if said game comprises video keno, said video image comprising an image of a bingo grid if said game comprises video bingo, said controller being programmed to determine a value payout associated with an outcome of said game, said value payout comprising a plurality of award components, and said controller being programmed to cause an audible explanation to be generated, said audio explanation sequentially explaining how each of said award components contributes to said value payout.

2. A gaming apparatus as defined in claim 1 wherein said controller is programmed to highlight at least one award component corresponding to winning combination of game elements associated with stored payout data.

3. A gaming apparatus as defined in claim 2 wherein said controller is programmed to sequentially highlight each of a plurality of winning combinations of game elements wherein each of said winning combinations is highlighted one at a time.

4. A gaming apparatus as defined in claim 3 wherein said controller is programmed to cause an audible explanation of each of said at least one winning combinations to be generated, each audible explanation being generated while an associated winning combination is highlighted.

5. A gaming apparatus as defined in claim 1 wherein said controller is programmed to generate said audible explanation in one of a plurality of languages, wherein said controller generates said audible explanation in the one of said plurality of languages in response to player information input at said gaming apparatus.

6. A gaming apparatus as defined in claim 1 wherein said controller is programmed to generate said audible explanation of said value payout in response to a user input requesting said audible explanation.

7. A gaming apparatus of as defined in claim 1 wherein said gaming apparatus comprises a slot machine including a plurality of rotatable mechanical slot machine reels, each of said plurality of rotatable slot machine reels have a plurality of slot machine symbols disposed thereon.

8. A gaming system comprising a plurality of gaming apparatuses as defined in claim 1, said gaming apparatuses being interconnected to form a network of gaming apparatuses.

9. A gaming system as defined in claim 8, wherein said gaming apparatuses are interconnected via the Internet.

10. A gaming apparatus, comprising:

a display unit to generate video images;

a value input device;

a controller operatively coupled to said display unit and said value input device, said controller comprising a processor and a memory operatively coupled to said processor, said controller being programmed to allow a person to make a wager, said controller being programmed to allow a person to make a payline selection, said controller being programmed to cause a video image to be generated on said display unit, said video image comprising a plurality of simulated slot machine reels of a slots game, each of said slot machine reels having a plurality of slot machine symbols, said controller being programmed to determine a value payout associated with an outcome of said slots game represented by a configuration of said slot machine symbols contained within said video image, said value payout comprising a plurality of award components, and said controller being programmed to cause a verbal explanation to be generated, said verbal explanation sequentially explaining how each of said award components contributes to said value payout of said slots game based on the configuration of said slot machine symbols, said payline selection, and stored payout data.

11. A gaming apparatus as defined in claim 10 wherein said controller is programmed to allow a user to select a number of paylines.

12. A gaming apparatus as defined in claim 10 wherein said controller is programmed to highlight an award component corresponding to a winning combination of game elements associated with said stored payout data.

13. A gaming apparatus as defined in claim 10, wherein said controller is programmed to cause said verbal explanation of said payout value in one of a plurality of languages, wherein said controller generates said verbal explanation in the one of said plurality of languages in response to player information input at said gaming apparatus.

14. A gaming apparatus as defined in claim 10, wherein said controller is programmed to cause said verbal explanation of said value payout to be generated in response to a user input requesting said verbal explanation.

15. A gaming apparatus as defined in claim 10, wherein said controller generates said verbal explanation of said value payout generated while visually highlighting said slot machine symbols for a person.

16. A gaming system comprising a plurality of gaming apparatuses as defined in claim 10, said gaming apparatuses being interconnected to form a network of gaming apparatuses.

17. A gaming apparatus, comprising a display unit to generate video images;

a value input device;

a controller operatively coupled to said display unit and said value input device, said controller comprising a processor and a memory operatively coupled to said processor;

said controller being programmed to allow a person to make a wager, said controller being programmed to allow a person to make a payline selection, said controller being programmed to cause a video image to be generated on said display unit, said video image comprising a plurality of simulated slot machine reels of a slots game, each of said slot machine reels having a plurality of slot machine symbols, said controller being programmed to calculate a total payout value of said slots game represented by said wager and a plurality of payline combinations, said payline combinations corresponding to stored payout data;

said controller being programmed to sequentially generate a corresponding visual indication of each of said plurality of payline combinations corresponding to said total value payout, and said controller being programmed to sequentially generate an audible explanation of how each one of said plurality of payline combinations contributes to the total payout value while a corresponding visual indication of said one payline combination is generated.

18. A gaming apparatus as defined in claim 17 wherein each of said plurality of payline combinations is visually identified successively.

19. A gaming apparatus as defined in claim 17 wherein said controller is programmed to cause a text explanation corresponding to each of said payline combinations to be generated while each of said payline combination is visually identified.

20. A gaming apparatus as defined in claim 17 wherein said controller is programmed to generate said audible explanation of said value payout in response to a user input.

21. A gaming apparatus, comprising:

a display unit to generate video images;

a value input device;

a controller operatively coupled to said display unit and said value input device, said controller comprising a processor and a memory operatively coupled to said processor, said controller being programmed to allow a person to make a wager;

said controller being programmed to cause a video image to be generated on said display unit, said video image representing a casino game, said controller being programmed to determine, after said video image has been displayed, a value payout associated with an outcome of said casino game, said value payout comprising a plurality of award components, and said controller being programmed to audibly and sequentially explain how each of said award components contributes to said value payout.

22. A gaming apparatus as defined in claim 21 wherein said controller is programmed to highlight an award component corresponding to a winning combination of game elements associated with stored payout data.

23. A gaming apparatus as defined in claim 21 wherein said controller is programmed to audibly explain said value payout in one of a plurality of languages, wherein said controller generates said verbal explanation in the one of said plurality of languages in response to player information input at said gaming apparatus.

24. A gaming apparatus as defined in claim 21 wherein said controller is programmed to audibly explain said value payout in response to a user input.

25. A gaming system, comprising a plurality of gaming apparatuses as defined in claim 21 said gaming apparatuses being interconnected to form a network of gaming apparatuses.

26. A gaming apparatus for playing a slots game, said gaming apparatus comprising:

a user input device;

a value input device;

a plurality of rotatable mechanical slot machine reels, each of said slot machine reels having a plurality of slot machine symbols disposed thereon;

a controller operatively coupled to said user input device, said value input device, and said slot machine reels, said controller comprising a processor and a memory operatively coupled to said processor, said controller being programmed to allow a person to make a wager, said controller being programmed to allow a person to make a payline selection, said controller being programmed to determine a value payout associated with an outcome of said slots game represented by a configuration of said slot machine symbols, said value payout a plurality of award components, and said controller being programmed to cause an audible explanation to be generated, said audible explanation sequentially explaining how each of said award components contributes to said value payout of said slots game based on the configuration of said slot machine symbols, said payline selection, and stored payout data in response to a person activating the user input device.

27. A gaming apparatus as defined in claim 26 wherein said controller is programmed to visually highlight each component of said value payout.

28. A method of allowing a game to be played, comprising:

causing a plurality of slot machine reels to be rotated after a wager is made by a person, each of said slot machine reels having a plurality of slot machine symbols disposed thereon;

causing said slot machine reels to be stopped so that a plurality of slot machine symbols are visible to the person;

determining a value payout based on an outcome of said game, said value payout being based upon said wager and stored payout data;

said value payout comprising a plurality of award components; and generating a verbal explanation, said verbal explanation sequentially explaining how each of said award components contributes to said value payout based on said outcome of said game, said verbal explanation being limited exclusively to said value payout and not including any verbal explanation relating to any other possible outcome of a game.

29. A method as defined in claim 28 wherein each of said slot machine reels comprises an image of a slot machine reel and wherein said slot machine reels are rotated by generating images of a plurality of simulated slot machine reels being rotated.

30. A method as defined in claim 29 comprising highlighting said plurality of slot machine symbols contributing to said value payout.

31. A memory having a computer program stored therein, said computer program to be used in connection with a gaming apparatus, said memory comprising:

a first memory portion physically configured in accordance with computer program instructions that would cause the gaming apparatus to allow a person to make a wager;

a second memory portion physically configured in accordance with computer program instructions that would cause the gaming apparatus to cause a video image to be generated on a display unit, said video image representing a game selected from the group of games consisting of video poker, video slots, video keno and video bingo, said video image comprising an image of at least five playing cards if said game comprises video poker, said video image comprising an image of a plurality of simulated slot machine reels if said game comprises video slots, said video image comprising an image of a plurality of keno numbers if said game comprises video keno, said video image comprising an image of a bingo grid if said game comprises video bingo, a third memory portion physically configured in accordance with computer program instructions that would cause the gaming apparatus to determine a value payout associated with an outcome of said game, said value payout comprising a plurality of award components; and a fourth memory portion physically configured in accordance with computer program instructions that would cause the gaming apparatus to generate a verbal explanation sequentially explaining how each of said award components contributes to said value payout.

32. A memory as defined in claim 31 wherein said memory additionally comprises a fifth portion physically configured in accordance with computer program instructions that would cause the gaming apparatus to visibly highlight said video image of an award component.

33. A memory as defined in claim 31 wherein said memory additionally comprises a fifth portion physically configured in accordance with computer program instructions that would cause the gaming apparatus to flash a payline containing an award component corresponding to a winning combination.

34. A memory as defined in claim 31 wherein said memory additionally comprises a fifth portion physically configured in accordance with computer program instructions that would cause the gaming apparatus to generate a textual display of said value payout.

35. A gaming apparatus as defined in claim 5 further comprising a card reader operatively coupled to said controller, wherein said controller is programmed to cause said card reader to read player information stored on a storage medium disposed within said card reader.

36. A gaming apparatus as defined in claim 13 further comprising a card reader operatively coupled to said controller, wherein said controller is programmed to cause said card reader to read player information stored on a storage medium disposed within said card reader.

37. A gaming apparatus as defined in claim 1 further comprising an input device operatively coupled to said controller, wherein said controller is programmed to generate said audible explanation in response to a player request received through said input device.

38. A gaming apparatus as defined in claim 1 wherein said controller is programmed to cause said audible explanation to be generated in response to at least one award component corresponding to a winning combination of game elements associated with stored payout data.

39. A gaming apparatus as defined in claim 10 further comprising an input device operatively coupled to the controller, wherein said controller is programmed to generate said verbal explanation in response to a player request received through said input device.

40. A gaming apparatus as defined in claim 10 wherein said controller is programmed to cause said verbal explanation to be generated in response to at least one award component corresponding to a winning combination of game elements associated with stored payout data.

* * * * *